United States Patent [19]

Smith

[11] 4,059,908

[45] Nov. 29, 1977

[54] METHOD FOR IMPROVING THE STABILITY OF SEEDS

[76] Inventor: Walton J. Smith, East Grafton, N.H. 03240

[21] Appl. No.: 671,996

[22] Filed: Mar. 30, 1976

[51] Int. Cl.[2] ..... F26B 5/04

[52] U.S. Cl. ..... 34/15; 34/16.5

[58] Field of Search ..... 34/15, 16.5, 92

[56] References Cited

U.S. PATENT DOCUMENTS 3,672,068 6/1972 Wilkison ..... 34/15

*Primary Examiner*—John J. Camby

*Attorney, Agent, or Firm*—Larson, Taylor and Hinds

[57] ABSTRACT

A method of improving the stability of primarily dry seeds which comprises a step of secondary drying of the seeds at a first temperature of from 50° to 60° C and under a vacuum of at least 100 microns Hg for from 30 minutes to 24 hours wherein the secondary drying is carried out in four or five steps at temperature increments of from 10° to 15° C. increasing successively from an initial temperature of from 50° to 60° C to a final temperature of from 90° to 100° C.

4 Claims, No Drawings

METHOD FOR IMPROVING THE STABILITY OF SEEDS

This invention relates to an improved method for improving the stability of seeds, including improvement in the stability of the seeds to freezing and to heat. In most seeds this will also result in an increased life expectancy under conditions of hermetic storage.

It is a well-known fact that seeds as collected from their natural sources usually do not retain their viability for long periods and the primary cause of this short life expectancy is a high moisture content which permits many biochemical processes to take place which expend these nutrients.

Accordingly, it is customary practice to dry the seeds for storage when viability is of interest. This is done commercially in large driers at atmospheric pressure with warm air. Some drying is done simply by letting the seeds stand in trays in a dry room until the moisture content of the seeds has been reduced.

Some seeds as they are collected from natural sources already have a moisture content which, coupled with protective seedcoats, guarantee a reasonable shelf life. Such naturally dry or commercially dried seeds I will refer to herein after as "primarily dry seeds".

In all the processes mentioned above, the seeds after drying have a moisture content which provides a shelf life permitting planting the seeds the following year with reasonable expectation of germination and in some cases, depending upon the seed, longer.

For laboratory purposes, some investigators have dried seeds in desiccators over sulfuric acid and similar drying agents, and the vitality of the seeds has been thereby prolonged, but such methods are not commercially feasible, requiring excessive time periods.

I have discovered that many commercial seeds even after drying have a very substantial moisture content and they lose some of their vitality and viability each month at room temperature, even though they are stored in dry rooms at reasonable temperatures. I have searched for techniques and methods for determining this viability and vitality and I have found that these deteriorating seeds show a sensitivity to heat and freezing as evidenced by their degree of germination and to some extent their vitality. I have now discovered a process for improving the stability of these seeds.

Accordingly, the present invention provides a method of improving the stability of primarily dry seeds which comprises a step of secondary drying of the seeds at a first temperature of from 50°–60° C and under a vacuum of at least 100 microns Hg for sufficient time to render the seeds stable to exposure to a second temperature 10° C higher than the first temperature without substantial loss of viability.

The secondary drying step can be repeated at the second temperature to render the seeds stable to exposure to a third temperature 10° C higher than the second temperature without substantial loss of viability.

Many commercial seeds are not stable to heat above 50° C. and if they are heated at atmospheric pressure for an hour or so above this temperature, when they are tested, it will be found that they do not germinate and if there are any seeds which germinate, the vitality of these seeds will be found to be reduced.

Many commercial seeds are not stable to freezing. Thus, if these seeds are frozen in liquid air, then allowed to thaw and tested for ability to germinate, it will be found that they no longer germinate but are dead.

I have discovered that by reducing the moisture content of seeds to a low value, they may be heated to as high as 90° C. without substantial injury and they may be frozen in liquid air similarly without substantial injury. I have accomplished this by drying under very high vacuum with simultaneous heating increasing the temperature gradually in steps often to as high as 90° C. but always above about 50° C.

Even though the seeds may be rather large and have protective seed coats, I have demonstrated that there is still a gradual loss of moisture under these conditions.

EXAMPLE 1

A sample of radish seeds (Champion) was heated in a beaker in the oven at 90° C. for one hour. At the end of that time after cooling the seeds were cultivated on filter paper wetted with distilled water and put in an incubator at 78° F for three days. At the end of that time no germination occurred and the seeds were found to be dead and subject to infection. A parallel study with unheated seeds showed good germination and growth.

EXAMPLE 2

A sample of radish seeds (same lot as in Example 1) were put in a beaker and liquid air was poured onto them and allowed to stand for about five minutes with liquid air. The liquid air was then allowed to evaporate in a desiccator, and after warming and drying, the seeds were cultivated as in Example 1. After three days in the incubator, it was found that they did not germinate, while the untreated seeds as before showed good germination.

EXAMPLE 3

Approximately 30 grams of radish seeds (same lot as in Example 1) were dried at 55° C for 8 hours in a vacuum oven using a vacuum of approximately 100 microns Hg (pressure) using a dry iceacetone condenser to trap the water vapour. At the end of this period, they were allowed to cool and a sample taken and tested for viability. They were found to have substantially the same viability as an unheated and undried control sample.

The seeds were then put in the vacuum oven and heated to 75° C under the same high vacuum after having been heated to 65° C first for a prolonged period. After the original vacuum drying at 55° C, the seeds lost 4.37% in weight, and after this latter drying at 75° C, they lost in 20 hours an additional 1% in weight.

This drying was then continued in the vacuum oven, this time for 24 hours at 95° C with the temperature being raised in approximately 10° C increments finally arriving at 95° C. The final total weight loss was slightly less than 6% of the original weight.

Of the total weight loss during these vacuum drying operations, one-quarter of the loss occurred at the highest temperature demonstrating the importance of this final step in this seed.

A sample of the seeds after the 95° C drying was evaluated and found to have substantially the same viability as the original seeds.

EXAMPLE 4

The above was repeated with many other types of seeds including cucumber, lettuce, clover, and cabbage. The results were similar. It was demonstrated that the stability of the vacuumdried seeds was increased that viability was retained so that they could withstand 90° C for one hour and liquid air for 5–10 minutes.

Smaller seeds are more easily dried under the above conditions because the moisture does not have to pass through such a distance, and drying times can be reduced somewhat.

Once dried, the seeds are preferably stored under hermetic conditions so that the moisture is not taken up until they are planted. This is especially an advantage in storing bulk quantities of seeds prior to subdivision into packets. It is desirable to exclude air and oxygen from the seeds for bulk storage for long periods to prevent any oxidation of seed nutrients.

It is expected that seeds prepared in the above way using the technique described will have substantial viability over periods of years when stored over nitrogen in sealed containers. Obviously this is not practical to be proven at this point under ordinary temperature storage, but the above tests at 95° C can be expected to indicate the effect of time when protected as indicated.

I have found that most commercial seeds can withstand 50° C. for short periods, however, if the moisture content is quite high, it is advisable to predry the seeds using ordinary known methods until they can withstand a 50° C. temperature before using the high-vacuum drying conditions described above. Such seeds are primarily dried seeds.

In the examples given above, it will be noted that the temperature is increased in steps of about 10° C. This is done with equal time intervals at each step, usually several hours, though smaller seeds which have a smaller path for the moisture to pass require a shorter interval at each temperature. The type of seed coat is also a factor, and the radish seed coat is an example of one which is fairly permeable to moisture. Very tough and less permeable seed coats require longer times at each temperature depending upon the initial moisture content.

The secondary drying is preferably carried out in a series of steps of increasing temperature, commencing at a temperature of from 50° to 60° C. and increasing in increments of from 5° to 20° C each, preferably of from 10° to 15° C, up½to a final temperature of from 90° to 100° C. Four or five steps are preferred. Each step should last from 30 minutes to 24 hours, preferably from one to eight hours.

Though apparently effective with all seeds, it does not appear that there is much commercial significance in the application of the invention to grain seeds and seeds intended for animal or human consumption. However, it is of particular value for more exotic seeds such as flower seeds, some small commercial seeds such as tobacco seeds, and some specific commercial seeds where there is a viability problem.

I claim:

1. A method of improving the stability of primarily dry seeds obtained by naturally or commercially drying seeds to reduce their moisture content and thereby improve their vitality and viability which comprises a step of secondary drying of the seeds at a first temperature of from 50° to 60° C and under a vacuum of at least 100 microns Hg for from 30 minutes to 24 hours and then repeating the secondary drying step at temperature increments of from 5° to 20° C each.

2. A method according to claim 1 wherein the secondary drying is carried out in four or five steps at temperature increments of from 10° to 15° C. increasing successively from an initial temperature of from 50° to 60° C. to a final temperature of from 90° to 100° C., each step lasting from 1 to 8 hours, and each being conducted under a vacuum of at least 100 microns Hg.

3. A method according to claim 1 wherein the seeds are subsequently stored in the absence of oxygen.

4. Seeds produced by the method of claim 1.

* * * * *